US006919674B2

(12) United States Patent
Jeong

(10) Patent No.: US 6,919,674 B2
(45) Date of Patent: Jul. 19, 2005

(54) ELECTRON GUN FOR COLOR CATHODE RAY TUBE

(75) Inventor: Tae Gwan Jeong, Gyeongsangbook-do (KR)

(73) Assignee: LG. Philips LCD Co., Ltd., Seoul (KR)

( * ) Notice: Subject to any disclaimer, the term of this patent is extended or adjusted under 35 U.S.C. 154(b) by 129 days.

(21) Appl. No.: 10/652,501

(22) Filed: Sep. 2, 2003

(65) Prior Publication Data

US 2004/0145294 A1 Jul. 29, 2004

(30) Foreign Application Priority Data

Jan. 27, 2003 (KR) ..... 10-2003-0005156
Mar. 7, 2003 (KR) ..... 10-2003-0014279

(51) Int. Cl.[7] ..... H01J 29/50

(52) U.S. Cl. ..... 313/412; 313/414; 315/85

(58) Field of Search ..... 313/412, 414, 313/447, 448, 458, 460; 315/85, 382

(56) References Cited

FOREIGN PATENT DOCUMENTS

| | | |
|---|---|---|
| JP | 06-122945 | 5/1994 |
| JP | 2002-080940 | 3/2002 |
| JP | 2002-129293 | 5/2002 |

*Primary Examiner*—Vip Patel
(74) *Attorney, Agent, or Firm*—McKenna Long & Aldridge LLP

(57) ABSTRACT

The present invention relates to a cathode ray tube, and more particularly, to a cathode ray tube with reduced stray emissions by improving the electrical conductivity of an electrode material of an electron gun housed in a funnel of the cathode ray tube.

20 Claims, 5 Drawing Sheets

ELECTRON GUN FOR COLOR CATHODE RAY TUBE

This application claims the benefit of Korean Patent Application Nos. 2003-5156 and 2003-14279, filed on Jan. 27, 2003 and Mar. 7, 2003, which is hereby incorporated by reference for all purposes as if fully set forth herein.

BACKGROUND OF THE INVENTION

1. Field of the Invention

The present invention relates to a cathode ray tube, and more particularly, to a cathode ray tube with reduced stray emissions though improving the electric conductivity of electrode material of an electron gun housed in a funnel of the cathode ray tube.

2. Background of the Related Art

FIG. 1 is a diagram explaining the structure of a known color cathode ray tube. The cathode ray tube may include a front glass panel 8, a funnel 1 coupled to the panel 8, a fluorescent screen 7 formed on an inside surface of the panel 8, a shadow mask 6 with a color selection function, the shadow mask being disposed at a predetermined distance from the fluorescent screen 7, an electron gun 3 for emitting electron beams, the electron gun housed inside a neck portion 5 of the funnel 1, and a deflection yoke 4 for deflecting the electron beams emitted from the electron gun 3 in a designated direction.

The panel 8 and the funnel 1 are coupled to each other through a frit glass, maintaining the inside thereof in a vacuum state. Also, a stem pin 2 for applying a voltage to the election gun in the vacuum is connected to the end of the neck portion 5.

According to this cathode ray tube, when a voltage is applied to the electron gun 3 from the stem pin 2, the electron gun 3 emits electron beams. The emitted electron beams are deflected vertically and horizontally by the deflection yoke 4 and eventually strike the fluorescent screen 7, displaying a designated image.

FIG. 2 is a diagram explaining the construction of a conventional electron gun. As depicted in the drawing, the electron gun 3 is composed of a tripolar portion including a cathode 12 for emitting electrons, a control electrode (G1) 13, and an accelerating electrode (G2) 14, a plurality of focus electrodes 15, 16, 17, and 18, the focus electrodes being disposed at a designated distance from the accelerating electrode 14, an anode 19, and a shield cup 20 for shielding leakage magnetic fields, the shield cup 20 being attached to an end of the anode 19. Further, there is a glass rod 23 for fixating each electrode, and a BSC 28 for supporting the electron gun 5 housed in the neck portion 5. The electron gun 3 is coupled to the neck portion 5 of the funnel in the vicinity of a stem portion 25.

As different voltages are applied to the respective electrodes, the electron beams emitted from the electron gun 3, more particularly, the cathode 12 thereof, are focused and accelerated, and finally strike the fluorescent screen 7 displaying a designated image. However, there could be many problems if the internal voltage characteristic of the electron gun 3 deteriorated. One of the most frequent problems is stray emissions. Stray emissions are a phenomenon in which electron beams are arbitrarily emitted from the fluorescent screen 1, the inside of the funnel 1, or the inside wall of the neck portion 5. In fact, these stray emissions are fatal to the quality of the cathode ray tube. Therefore, a knocking process is often used to reduce the stray emission. The knocking process involves applying a knocking high voltage to the shield cup 20 or the anode 19 of the electron gun 3 and inducing a high voltage in the conductive electrode for an instant, in order to remove metallic burrs or foreign substances stuck onto the electrode. Through the knocking process, it becomes possible to get rid of undesirable emission factors besides R, G, and B electron beams.

FIG. 3 is a diagram explaining the relation between a knocking voltage and stray emissions. When the knocking voltage is high, stray emissions are reduced, i.e., as the knocking voltage is increased, the metallic burrs or foreign substances stuck onto the electrode are more easily eliminated. A possible drawback of this process is that although stray emissions might be reduced when a high knocking voltage is applied, the high voltage can damage the cathode ray tube 12 or cause a base-leak in the vicinity of the stem portion 25. Moreover, a high knocking voltage should be very carefully applied after giving much consideration to the conditions associated with the connection structure of the electron gun and the knocking method.

SUMMARY OF THE INVENTION

Accordingly, the present invention is directed to an electron gun for color cathode ray tube that substantially obviates one or more of the problems due to limitations and disadvantages of the related art.

An advantage of the present invention is that it solves at least the problems described above and/or disadvantages and provides at least the advantages described hereinafter.

Accordingly, one advantage of the present invention is to provide a cathode ray tube with reduced stray emissions by performing a knocking process without damaging an electron gun in the cathode ray tube.

Another advantage of the present invention is to provide a cathode ray tube capable of minimizing stray emissions by providing an electrode material for use in an electron gun, the material being able to optimize the effect of file knocking process and to improve the internal voltage characteristic of the electron gun.

The foregoing and other advantages are realized by providing a cathode ray tube including: a front glass panel; a funnel coupled to the panel; a fluorescent screen formed on an inside surface of the panel; a shadow mask with a color selection function, the shadow mask being disposed at a predetermined distance from the fluorescent screen; an electron gun for emitting electron beams, the electron gun housed inside a neck portion of the funnel; and a deflection yoke for deflecting the electron beams emitted from the electron gun in a designated direction, wherein the electron gun comprises a tripolar portion composed of a cathode, a control electrode, and an accelerating electrode, a plurality of focus electrodes being sequentially disposed at regular intervals, an anode, and a shield cup, and at least one electrode of the electron gun is made of a Fe—Cr—Ni alloy with an electric conductivity higher than 12,200 mho/m.

To achieve these and other advantages and in accordance with the purpose of the present invention, as embodied and broadly described, are realized by providing a cathode ray tube including: a front glass panel; a funnel coupled to the panel; a fluorescent screen formed on an inside surface of the panel; a shadow mask with a color selection function, the shadow mask being disposed at a predetermined distance from the fluorescent screen; an electron gun for emitting electron beams, the electron gun housed inside a neck portion of the funnel; and a deflection yoke for deflecting the electron beams emitted from the electron gun in a designated direction, wherein the electron gun comprises a tripolar portion composed of a cathode, a control electrode, and an accelerating electrode, a plurality of focus electrodes being sequentially disposed at regular intervals, an anode, and a shield cup, and at least one electrode of the electron gun is made of a Fe—Cr—Ni alloy consisting of 14–18 wt % of Cr, 12–16 wt % of Ni, less than 1.2 wt % of Mn, and Fe and inevitable impurities for the rest.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Reference will now be made in detail to an embodiment of the present invention, example of which is illustrated in the accompanying drawings.

The present invention provides a way to reduce stray emissions by increasing the efficiency of the knocking process. By employing an electrode material with excellent electrical conductivity, it is possible to use a lower knocking voltage. At least one of electrodes of the electron gun may be made of an Fe—Cr—Ni alloy whose electric conductivity is greater than 12,200 mho/m. Moreover, at least one of electrodes of the electron gun may have an electrical conductivity in the range of 12,500–13,500 mho/m, in considerations of the thermal expansion rate of the electrodes. Especially, one of several electrodes of the electron gun and may be made of Fe—Cr—Ni alloy with an electrical conductivity greater than 12,200 mho/m.

In general, when a knocking voltage is applied to the shield cup, the knocking voltage is induced in respective electrodes. Therefore, when the electrodes are made from highly conductive materials, the knocking effect will be much improved even when a uniform knocking voltage is applied. In short, if highly conductive metals are employed for the electrodes, it is possible to obtain an excellent knocking effect even when a relatively low knocking voltage has been applied, thereby preventing the problems caused by a high knocking voltage, such as, damages to the cathode or a base-leak around a stem portion.

An electrode material that can meet all the above requirements is Fe—Cr—Ni alloy. The alloy contains 14–18 wt % of Cr, 12–16 wt % of Ni, and 1.2 wt % of Mn, and Fe with inevitable impurities for the rest. Preferably, the Fe—Cr—Ni alloy contains less than 0.05 wt % of C. Preferably, the Fe—Cr—Ni alloy contains 0.5–1.0 wt % of Mn. This composition may maximize the knocking effect as well as improving the thermal characteristics of the electrodes.

As described above, at least one of the electrodes composing the electron gun may be made of the Fe—Cr—Ni alloy, and at least one of the electrodes may have a thickness in the range of 0.245–1.0 mm. Provided that at least one of the electrodes composing the electron gun is in a plate shape, the thickness of the plate may be in the range of 0.4–1.0 mm. Meanwhile, if the electrode is in a cap shape or a cup shape, its thickness may be in the range of 0.245–0.5 mm. Hence, at least one of the electrodes composing the electron gun may have an elongation higher than 40% and a magnetic permeability lower than 1.005, to maximize the effect of the knocking process while minimize the damage to the electron guns due to the knocking process.

Figure 1:
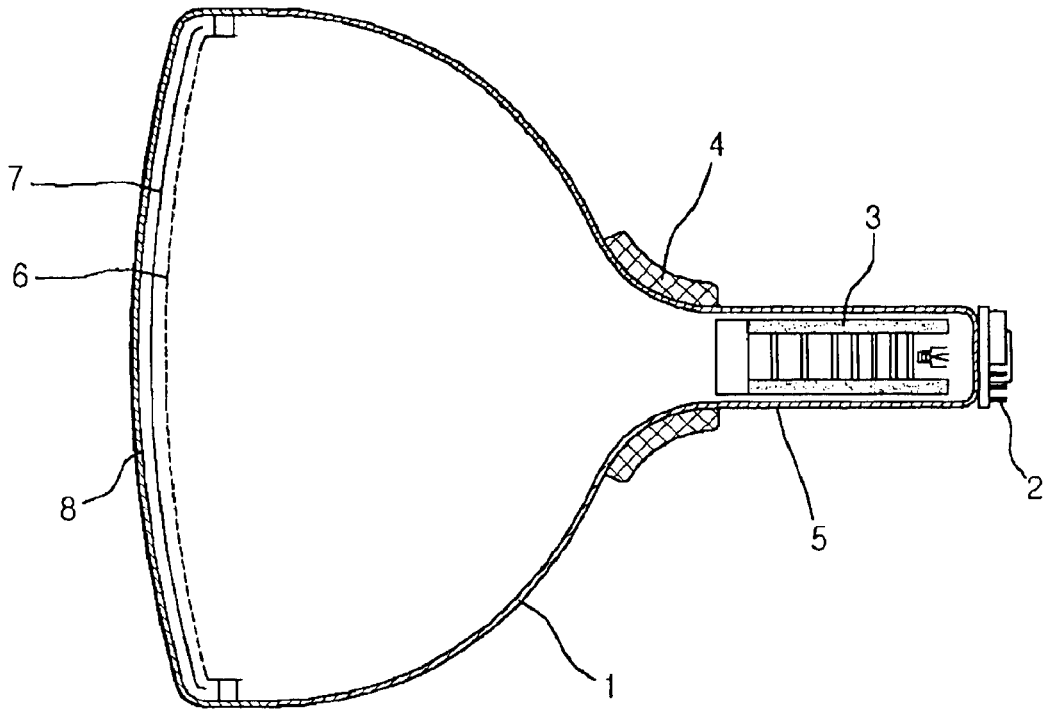
Fig.1 Related Art
FIG. 1 is a diagram explaining the structure of a cathode ray tube of the related art.
Figure 2:
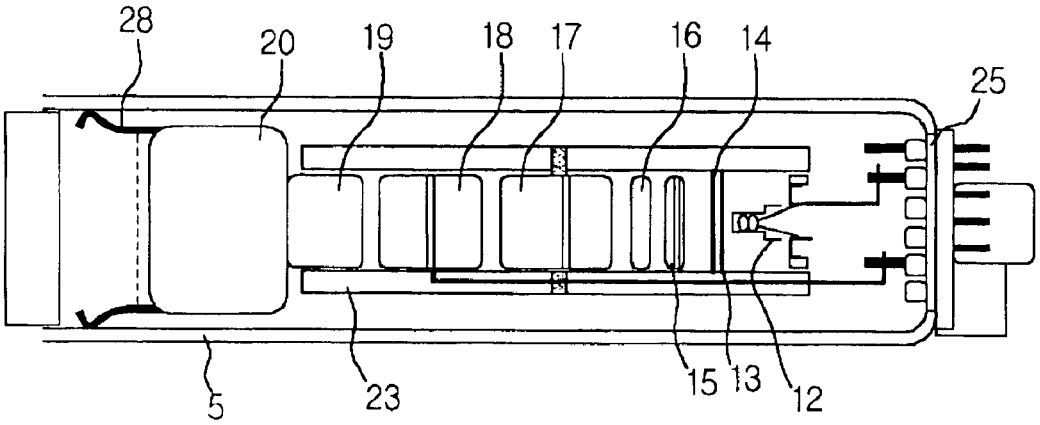
Fig.2 Related Art
FIG. 2 is a diagram explaining the structure of an electron gun in the related art.
Figure 3:
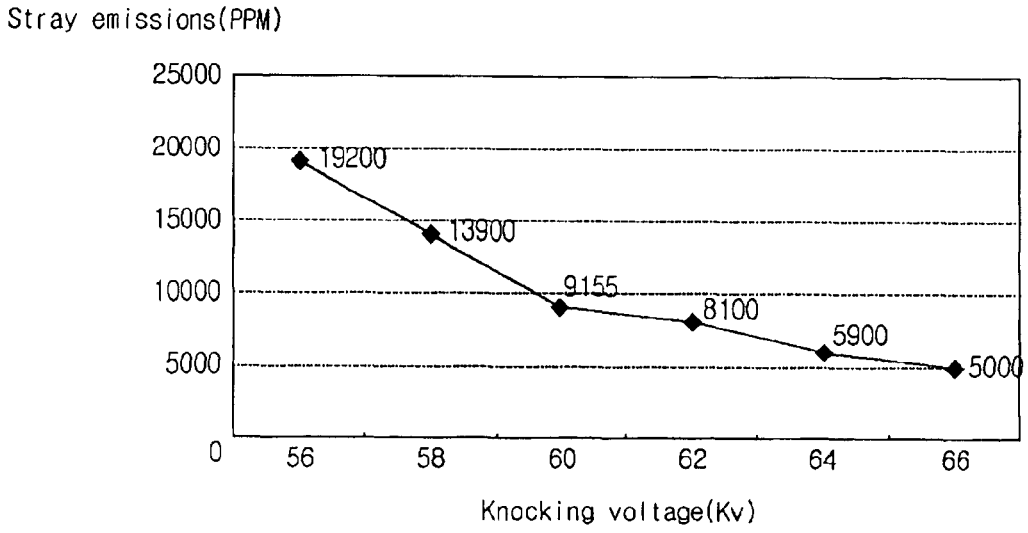
Fig.3 Related Art
FIG. 3 is a diagram explaining the relationship between a knocking voltage and stray emissions.
Figure 4:
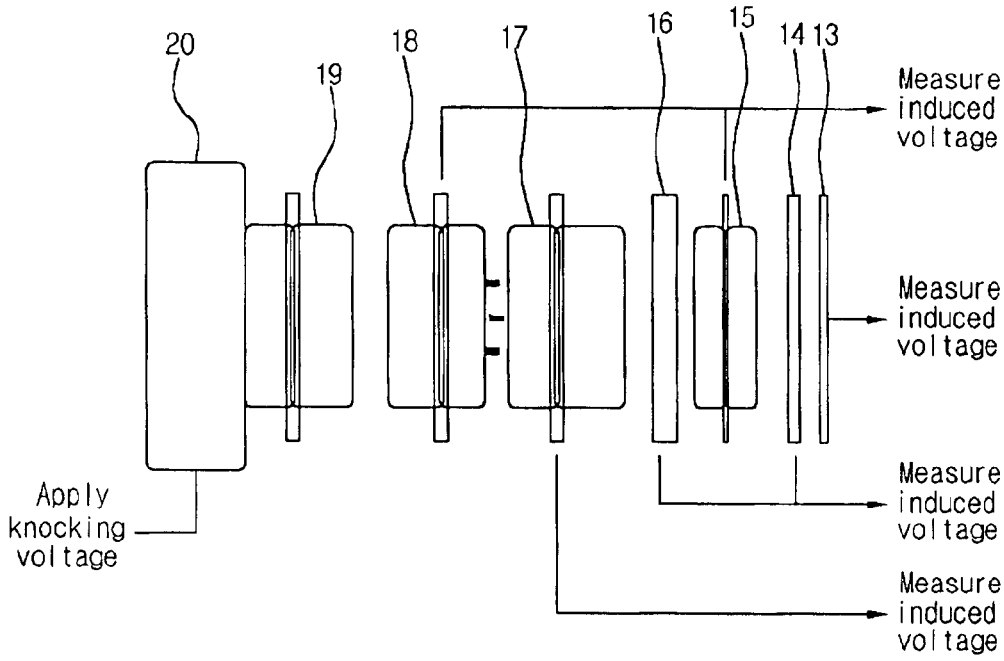
FIG. 4 is a diagram explaining an application of a knocking voltage according to a knocking process and the measurement of an induced voltage in a cathode ray tube according to the present invention.

FIG. 4 is a diagram explaining an application of a knocking voltage according to the knocking process of the present invention and the measurement of the induced voltage in the cathode ray tube. The knocking voltage may be applied to the shield cup 20, and each electrode may be made of the Fe—Cr—Ni alloy with an electrical conductivity higher than 12,200 mho/m. In this way, even though a relatively low knocking voltage might be applied, as long as the voltage is uniform, it is possible to improve the knocking effect. Also, the electrode material may be a Fe—Cr—Ni alloy with the electric conductivity in the range of 12,500–13,500 mho/m, in consideration of the thermal expansion rate of the electrodes. In other words, at least one of the electrodes of the electron guns, namely the control electrode 14, the accelerating electrode 15, a plurality of focus electrodes 15, 16, 17, and 18, the anode 19, and the shield cup 20, may be made of the Fe—Cr—Ni alloy with the electric conductivity higher than 12,200 mho/m or in the range of 12,500–13,500 mho/m.

Table 1 below compares the electrode materials used in the cathode ray tube of the present invention and in the cathode ray tube of the related art.

TABLE 1

| | Line resistance (Ω * m) | Electric conductivity (mho/m) | Induced voltage (kv) |
|---|---|---|---|
| Related art | 0.0000831 | 12,031 | 24 |
| Present invention | 0.00007671 | 13,068 | 28 |
| Difference (%) | −7.7 | 8.6 | 16.7 |

As shown in Table 1, when a new electrode material was used, having 8.7% improved electrical conductivity, i.e. 13,068 mho/m, compared to the conventional electrode material, was used, the induced voltage thereof was increased as much as 16.7%. In addition, when the knocking process was conducted using the electrode with the electric conductivity of 13,068 mho/m, the stray emissions were reduced as much as 40%. The above results were obtained because the highly conductive electrode material consequently improved the internal voltage characteristic of the electrode made of the material, and the knocking process could be carried out at a low knocking voltage.

Figure 5:
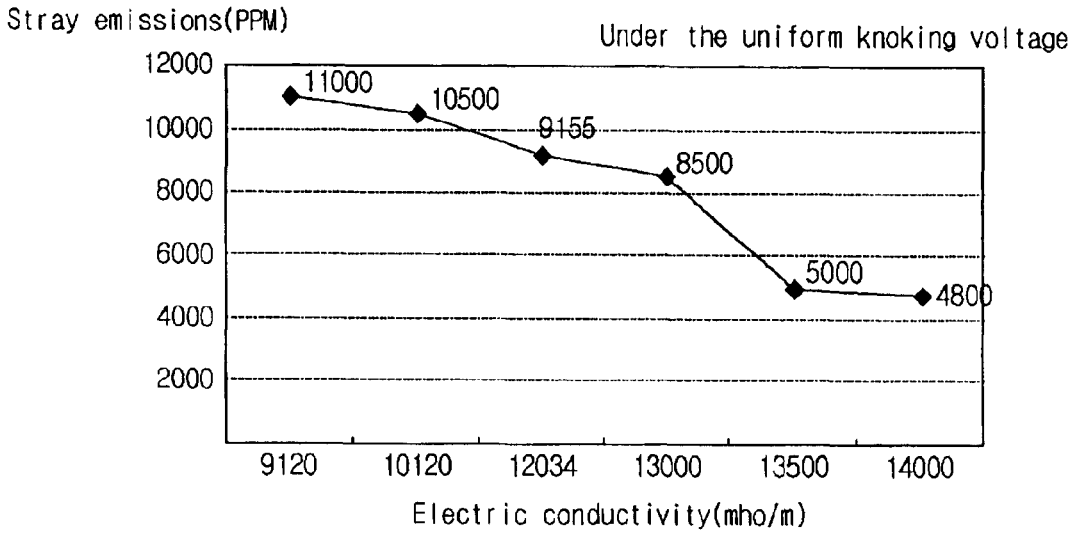
FIG. 5 is a diagram explaining the changes in stray emissions in response to the electric conductivity when a uniform knocking voltage is applied to the cathode ray tube according to the present invention.

FIG. 5 is a diagram showing the changes in the stray emissions in response to the electrical conductivity when a uniform knocking voltage is applied to the cathode ray tube according to the present invention. The graph shows that the electrical conductivity is inversely proportional to stray emissions, provided that a uniform knocking voltage is applied. In other words, the present invention introduces a Fe—Cr—Ni alloy having an electrical conductivity higher than 12,200 mho/m as the electrode material, and more particularly, a Fe—Cr—Ni alloy having an electrical conductivity in the rage of 12,500–13,500 mho/m, capable of reducing stray emissions and satisfying the thermal characteristics of the electrode. Also, the electrode material of the cathode ray tube is a Fe—Cr—Ni alloy, which contains 14–18 wt % of Cr, 12–16 wt % of Ni, less than 1.2 wt % of Mn, and Fe and inevitable impurities for the rest. Further, the electrode material may contain less than 0.05 wt % of C and 0.5–1.0 wt % of Mn.

The present invention is advantageous in that it may reduce stray emissions by carrying out the knocking process without damaging the electron gun. Moreover, the present invention introduces an electrode material that may maximize the effect of the knocking process and improve the interval voltage characteristic, while minimizing stray emissions.

While the invention has been shown and described with reference to certain preferred embodiments thereof, it will be understood by those skilled in the art that various changes in form and details may be made therein without departing from the spirit and scope of the invention as defined by the appended claims. For example, the electrode material introduced by the present invention may further include a small amount of Mg, S, and W metals.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A cathode ray tube comprising:

a front glass panel;

a funnel coupled to the panel;

a fluorescent screen formed on an inside surface of the panel;

an electron gun emitting electron beams; and a deflection yoke deflecting the electron beams emitted from the electron gun to a designated direction, wherein the electron gun comprises a tripolar portion composed of a sequentially disposed at regular intervals, an anode, and a shield cup, and at least one electrode of the electron gun is made of a Fe—Cr—Ni alloy with an electric conductivity higher than 12,200 mho/m.

2. The cathode ray tube according to claim 1, wherein at least one electrode of the electron gun is made of a Fe—Cr—Ni alloy with an electric conductivity in the range of 12,500–13,500 mho/m.

3. The cathode ray tube according to claim 1, wherein the Fe—Cr—Ni alloy includes 14–18 wt % of Cr, 12–16 wt % of Ni, less than 1.2 wt % of Mn, and Fe and inevitable impurities for the rest.

4. The cathode ray tube according to claim 1, wherein the Fe—Cr—Ni alloy contains less than about 0.05 wt % of C.

5. The cathode ray tube according to claim 1, wherein the Fe—Cr—Ni alloy contains 0.5–1.0 wt % of Mn.

6. The cathode ray tube according to claim 1, wherein at least one electrode of the plurality of focus electrodes, the anode, and the shield cup of the electron gun is made of a Fe—Cr—Ni alloy with an electric conductivity higher than 12,200 mho/m.

7. The cathode ray tube according to claim 1, wherein at least one electrode of the electron gun has a thickness of 0.245–1.0 mm.

8. The cathode ray tube according to claim 7, wherein at least one electrode of the electron gun is in a plate shape having a thickness of 0.4–1.0 mm.

9. The cathode ray tube according to claim 7, wherein at least one electrode of the electron gun is in a cap shape or a cup shape having a thickness of 0.245–0.5 mm.

10. The cathode ray tube according to claim 1, wherein at least one electrode of the electron gun has an elongation greater than about 40%.

11. The cathode ray tube according to claim 1, wherein at least one electrode of the electron gun has a magnetic permeability less than about 1.005.

12. A cathode ray tube, comprising:

a front glass panel;

a funnel coupled to the panel;

a fluorescent screen formed on an inside surface of the panel;

an electron gun emitting electron beams; and a deflection yoke deflecting the electron beams emitted from the electron gun in a designated direction, wherein the electron gun comprises a tripolar portion composed of a cathode, a control electrode, and an accelerating electrode, a plurality of focus electrodes being sequentially disposed at regular intervals, an anode, and a shield cup, and at least one electrode of the electron gun is made of a Fe—Cr—Ni alloy including 14–18 wt % of Cr, 12–16 wt % of Ni, less than 1.2 wt % of Mn, and Fe and inevitable impurities for the rest.

13. The cathode ray tube according to claim 12, wherein the Fe—Cr—Ni alloy contains less than about 0.05 wt % of C.

14. The cathode ray tube according to claim 12, wherein the Fe—Cr—Ni alloy contains 0.5–1.0 wt % of Mn.

15. The cathode ray tube according to claim 12, wherein at least one electrode of the electron gun is made of a Fe—Cr—Ni alloy with an electric conductivity higher than 12,200 mh o/m.

16. The cathode ray tube according to claim 12, wherein at least one electrode of the electron gun has a thickness of 0.245–11.0 mm.

17. The cathode ray tube according to claim 16, wherein at least one electrode of the electron gun is in a plate shape having a thickness of 0.4–1.0 mm.

18. The cathode ray tube according to claim 16, wherein at least one electrode of the electron gun is in a cap shape or a cup shape having a thickness of 0.245–0.5 mm.

19. The cathode ray tube according to claim 12, wherein at least one electrode of the electron gun has an elongation greater than about 40%.

20. The cathode ray tube according to claim 12, wherein at least one electrode of the electron gun has a magnetic permeability less than 1.005.

* * * * *

UNITED STATES PATENT AND TRADEMARK OFFICE

CERTIFICATE OF CORRECTION

PATENT NO. : 6,919,674 B2
APPLICATION NO. : 10/652501
DATED : July 19, 2005
INVENTOR(S) : Tae Gwan Jeong It is certified that error appears in the above-identified patent and that said Letters Patent is hereby corrected as shown below:

| | | |
|---|---|---|
| | Title Page | Assignee line 1 should read |
| Col. 1 | (73) | **LG Phililps Display Korea Co., Ltd.** |

Signed and Sealed this

Twenty-second Day of August, 2006

JON W. DUDAS
*Director of the United States Patent and Trademark Office*